US005388493A

United States Patent [19]

Curletto

[11] Patent Number: 5,388,493

[45] Date of Patent: Feb. 14, 1995

[54] EXTRA LOW PROFILE HOUSING FOR VERTICAL DUAL KEYBOARD MIDI WIRELESS CONTROLLER FOR ACCORDIONISTS

[76] Inventor: Giorgio F. Curletto, 6109 Nevada Ave., NW., Washington, D.C. 20015

[21] Appl. No.: 153,196

[22] Filed: Nov. 17, 1993

[51] Int. Cl.[6] ..... G10D 11/00

[52] U.S. Cl. ..... 84/376 A

[58] Field of Search ..... 84/376, 376 R, 376 A, 84/376 BA, 645

[56] References Cited

U.S. PATENT DOCUMENTS 4,884,488 12/1989 Curletto ..... 84/376 R 4,953,436 9/1990 Curletto ..... 84/376 A 5,099,737 3/1992 Curletto ..... 84/376 R 5,296,641 3/1994 Stelzel ..... 84/645 X

*Primary Examiner*—William M. Shoop, Jr.

*Assistant Examiner*—Jeffrey W. Donels

[57] ABSTRACT

An extra low profile housing for vertical dual keyboard MIDI wireless controller for accordionists, representing values and features of convenience, practicality and portability even further enhanced in its book-like folding version, in its three section interlocking modular version, and in its vertical horizontal dual-purpose version. The instrument can be used with either the traditional MIDI cable connection or by a wireless MIDI transmission system when so equipped.

4 Claims, 5 Drawing Sheets

Figure 1:
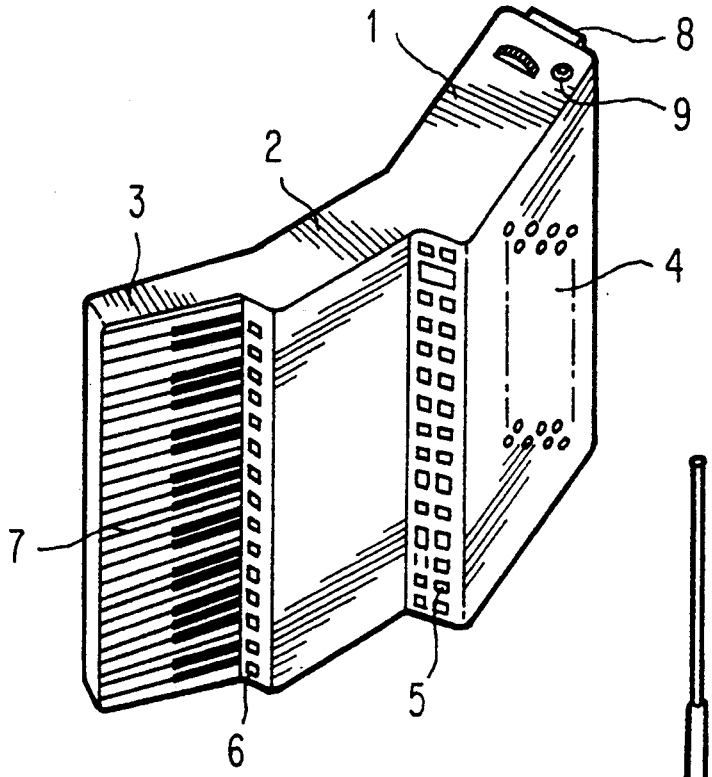

FIG. 7
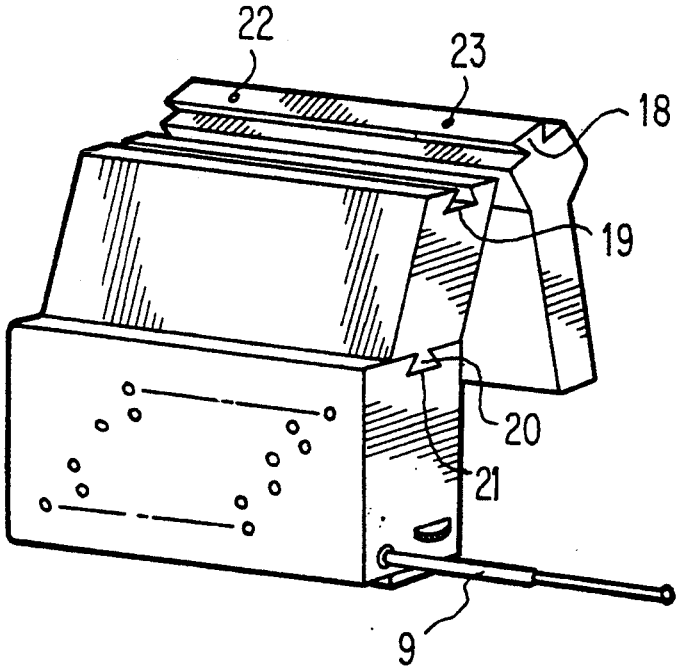
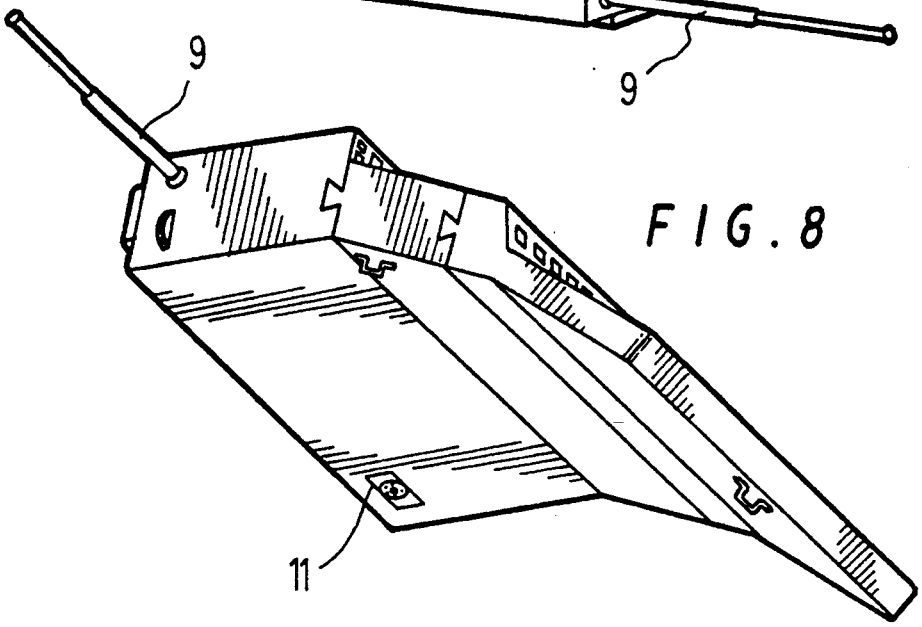
FIG. 8

EXTRA LOW PROFILE HOUSING FOR VERTICAL DUAL KEYBOARD MIDI WIRELESS CONTROLLER FOR ACCORDIONISTS

BRIEF SUMMARY OF THE INVENTION

The vertical dual keyboard MIDI controller (M.I.D.I. stands for Musical Instrument Digital Interface) is intended to further slenderize the shape and contour of the dual keyboard MIDI controller by taking advantage of and making use of the extremely compact left-hand bassboard with electronic contacts that occupies less than one third of the amount of room that the traditional accordion bassboard assemblies normally require on account of their long pistons. The vertical dual keyboard MIDI controller consists of three rectangular shaped members (the right-hand keyboard section; the mid section; and the left-hand bassboard section). The first section being the rectangular housing containing the right-hand keyboard (that can be a piano like keyboard or a chromatic buttonboard) immediately joining, lengthwise, the somewhat stepped-up higher rectangular mid section of the MIDI controller housing which, in turn, also merges, lengthwise, with the next stepped-up higher rectangular left-hand bassboard housing. The low profile dual keyboard MIDI controller owes its unprecedented thin profile to the fact that, as stated above, utilizes within its rectangular left-hand bassboard housing the extremely compact bassboard assembly with electronic contacts which requires an extremely shallow left-hand bassboard housing (approximately one and one-half inches in depth is the amount of space required to house the relatively thin bassboard assembly with electronic contacts as opposed to the traditional bassboards with long pistons that require a housing of at least six inches in depth), which can vary between three inches to four inches at the most to allow for the wiring and access. Moving from left to right, from the left-hand bassboard, the next section of the MIDI controller is the mid section connected lengthwise to the deeper bassboard housing on one side and on the other side joining longitudinally with the even more slender rectangular housing that contains the right-hand keyboard with electronic contacts requiring again a great deal less room than the traditional accordion keyboards normally occupy because of their long valve stems. The dual keyboard MIDI controller can be best described as an instrument housing consisting of three rectangular shaped progressive steps representing respectively the righthand keyboard housing, the mid section, and the left-hand bassboard housing (in that order, the depth of each rectangular section is one and one-half inches, two and one-quarter inches, and three and one-half to four inches), and the back surfaces of these three sections form a slightly curved outline to better adhere to the player's body contour.

A BRIEF DESCRIPTION OF THE SEVERAL VIEWS OF THE DRAWINGS

Enclosed are thre eleven drawings that I refer to as FIG. 1, FIG. 2, FIG. 3, FIG. 4, FIG. 5, FIG. 6, FIG. 7, FIG. 8, FIG. 9, FIG. 10 and FIG. 11.

Figure 2:
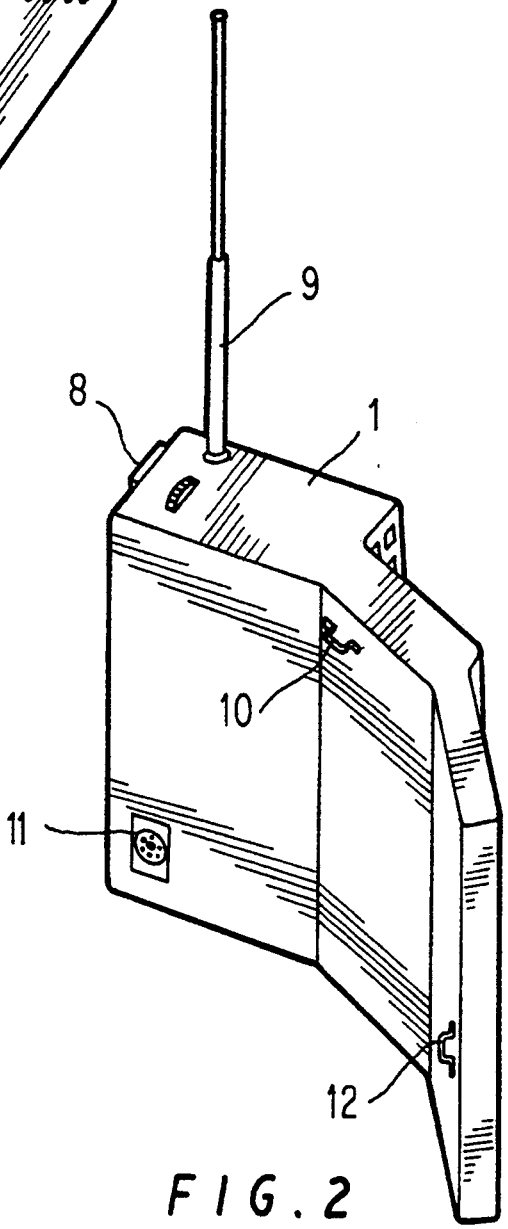
Figure 3:
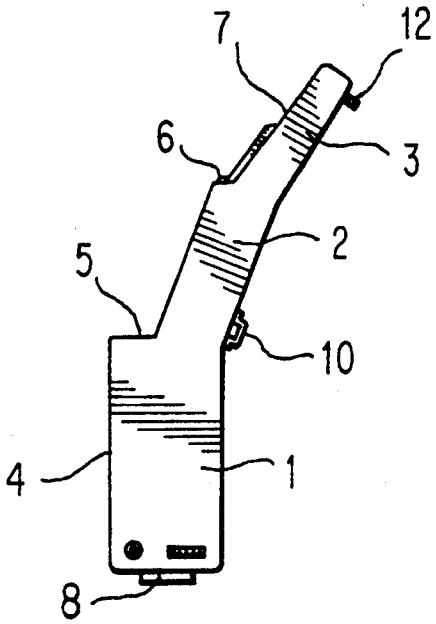

FIG. 1 illustrates the front view of the instrument. It clearly shows the three step-like shape of the instrument's contour, the presets' secondary control panel (Part 6) and the somewhat larger main control panel used for all programming operations (Part 5). FIG. 2 shows a transmitting telescopic antenna (Part 9) that indicates the instrument can be used as a wireless MIDI controller if equipped with the proper electronic MIDI hardware, and an over-all back view of the instrument (including Part 11 which is the instrument's MIDI connecting socket which also allows the use of the instrument by means of the MIDI cable, and Part 10 and Part 12 which represent the two attachments, on the back surface of the MIDI controller, that hold the single back strap fastened to the instrument. FIG. 3 illustrates the ultra slim profile of the instrument.

Figure 4:
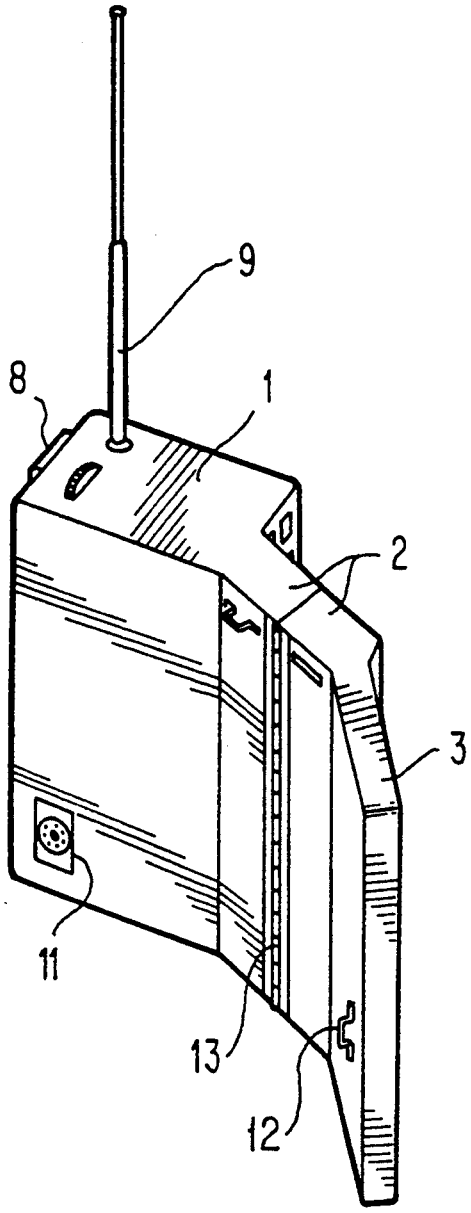

FIG. 4 shows a different version of the same low profile housing for vertical dual keyboard MIDI wireless controller. In this particular version, the instrument housing's rectangular mid section is cut lengthwise in half and its two sections consisting of the left-hand bassboard housing and the left longitudinal half of the divided mid section on one side, and on the other side, the right longitudinal half of the divided mid section and the right-hand keyboard housing. Part 13 of FIG. 4 shows the piano hinge that vertically connects the two rear surfaces of the divided mid section (as Part 2 indicates), and FIG. 5 clearly illustrates the folding feature of this version of the instrument designed to increase the degree of portability and practicality of same and Part 16 and Part 17 indicate the electronic circuit's connecting points that join together (each time the instrument is fully opened in playing position), in order to reestablish proper contact and flow of electronic information between the two halves of the MIDI controller. Part 14 and Part 15 represent the two lateral end cap surfaces pertaining to the two divided instrument's sections as per FIG. 5.

Figure 6:
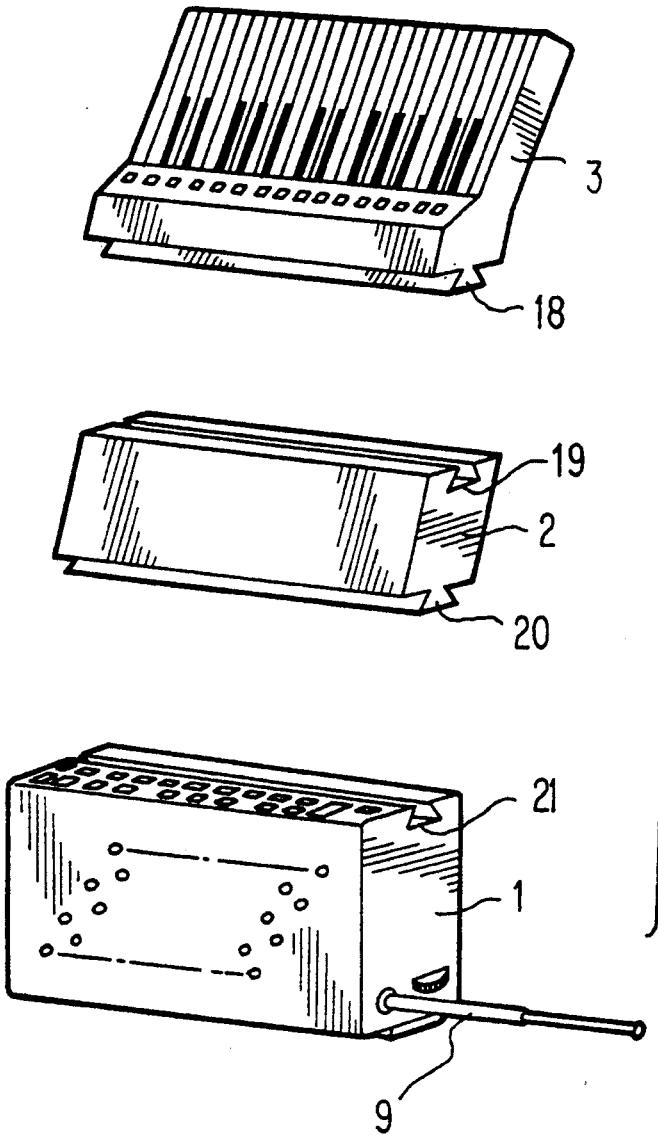

FIG. 6, FIG. 7, and FIG. 8 reveal another version of the dual keyboard MIDI wireless controller. FIG. 6 clearly shows the modular approach applied to the MIDI controller, and shows how the three sections of the instrument's housing are equipped with dove-tail like interlocking tracks and grooves (illustrated by Part 18, Part 19, Part 20, and Part 21) that allow a modular interlocking connection between the three sections of the instrument which could be interchangeable and easily replaced by other sections provided they are equipped with the same dove-tail connecting features. With this modular instrument housing, the mid section could be equipped with the electronic components contained in a sound module or expander and at a later date, it could be replaced by another interlocking mid section (with same dove-tail interlocking system) this time, however, containing an improved or more progressive sound module, therefore, providing endless possibilities by allowing to slide out the old cartridge (or mid section) and slide in a new updated and more sophisticated sound module as if it were a replacement cartridge. FIG. 7 shows the dove-tail like protruding track (Part 18) exposing Part 22 and Part 23 (two of the points of contact that are implanted at same intervals on each of the two protruding tracks Part 18 and Part 20) and that must precisely match their counterparts positioned on the receiving grooves below (Part 19 and Part 21, FIG. 6). FIG. 8 shows a general back view of the instrument with all three segments interconnected.

Figure 9:
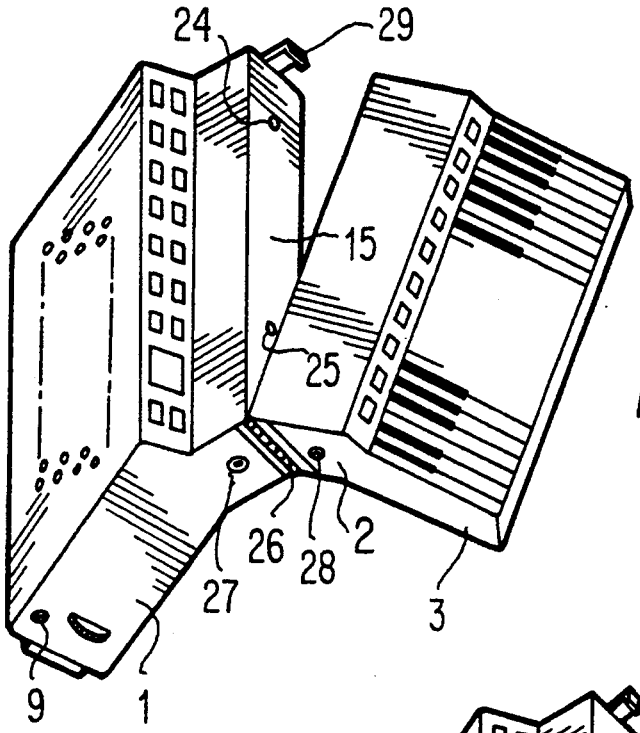
Figure 10:
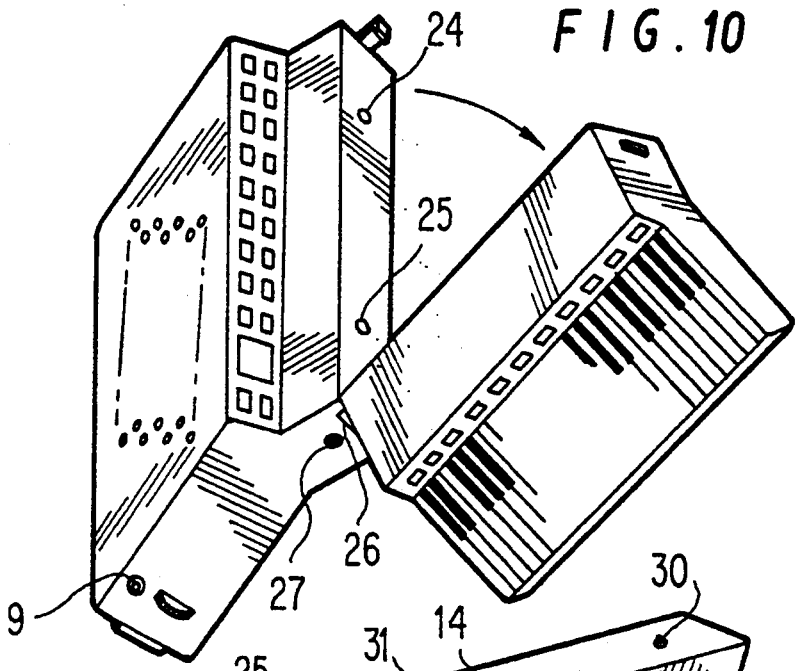
Figure 11:
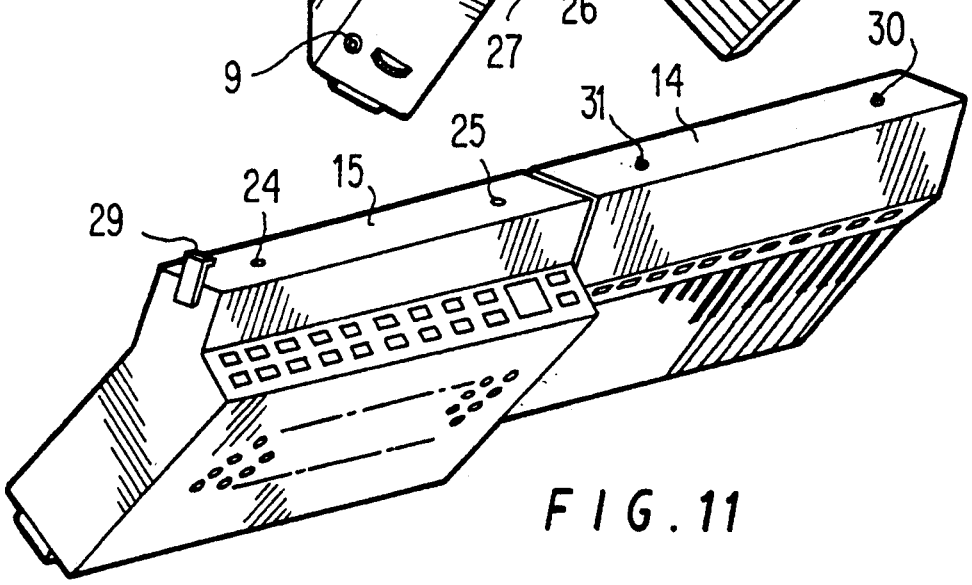

FIG. 9, FIG. 10, and FIG. 11 illustrate one more version of the instrument which makes it possible to play the dual keyboard MIDI controller either as a vertical instrument (like an accordion) or as a horizontal one. FIG. 9 shows Part 26 (the hinge connecting the two top narrow surfaces of the divided central section of the instrument housing Part 2). Like in the previously illustrated version in FIG. 4 and in FIG. 5, in this specific version the mid section (Part 2) is divided longitudinally in half. The hinge on the central top of the instrument (Part 26), when the catch that holds together the opposite two bottom surfaces of the divided mid section (the catch being Part 29, FIG. 9) is released, the two sections of the instrument, while remaining fully connected by the top hinge (Part 26, FIG. 9), can be separated and opened in a fanlike fashion until both top surface halves (conprising Part 1, the two divided segments of Part 2, and Part 3) come together and the two electronic contact points (Part 27 and Part 28, FIG. 10), therefore meet to establish the electronic circuit continuity (between the two halves of the instrument) also when the instrument is being used in the horizontal position as clearly illustrated in FIG. 11. When from a horizontal fully open position the two opened halves of the instrument are pushed back together (like closing a fan) until both inner surfaces (Part 14 and Part 15, FIG. 11) meet flush with one another and their respective contact points (Part 25 with Part 31 and Part 24 with Part 30) reestablish the necessary electronic connection between the two halves of the instrument and after securing same by means of the bottom latch (Part 29, FIG. 9), the instrument is again ready to be played vertically like an accordion.

DETAILED DESCRIPTION OF THE EXTRA LOW PROFILE HOUSING FOR VERTICAL DUAL KEYBOARD MIDI WIRELESS CONTROLLER FOR ACCORDIONISTS

The extra low profile housing is achieved by utilizing the bassboard assemblies with electronic contacts that thanks to their remarkable degree of compactness they only require less than one-third the space normally needed to house a traditional bassboard apparatus usually found in the conventional accordions. The bassboard consequently becomes extremely slender (between three and one-half inches to four inches deep), the mid section of the instrument is no deeper than two and one-quarter inches and the right-hand keyboard housing is just a mere one and one-half inches deep. The bassboard housing's portion of the instrument is, of course, of rectangular shape comprising a rectangular back surface in the lower left corner of which is positioned the out-of-sight MIDI connecting socket, a rectangular lateral surface where the bass strap is located (Part 8, FIG. 1), a frontal surface where the bassboard is located (Part 4, FIG. 1) and a consequently discending lateral elongated surface representing the primary control panel (Part 5, FIG. 1) and merging with its lower longitudinal edge with one of the two longitudinal edges of the frontal rectangular surface of the instrument's mid section (Part 2, FIG. 1) and merging, with its second longitudinal edge, with the extremely elongated rectangular narrow surface forming a descending lateral control panel (the secondary control panel Part 6, FIG. 1 consisting of a single row of preset buttons) joining with its lower longitudinal edge the full length of the frontal inner edge of the right-hand keyboard, and sweeping lengthwise across the frontal surface of the entire right-hand keyboard, the longitudinal outer edge of same joins with the external longitudinal lateral edge of the right-hand keyboard's housing which in turn immediately joins the extreme longitudinal outer edge of a rectangular surface representing the back portion of the keyboard housing (Part 3, FIG. 1), said rectangular back portion having on its extreme outer edge (just below its mid section) one of the two back strap's attachments, and said back portion merging, lengthwise, with the mid section's rectangular back surface where the second attachment of said back strap is positioned on its extreme upper left corner and where said same rectangular back surface joins lengthwise the bassboard housing's rear rectangular surface thus completing the entire description of all instrument's vertical rectangular surfaces. The top surface and the bottom surface (both surfaces consisting of the top and the bottom segments which comprise Part 1, Part 2, and Part 3, FIG. 1) complete the structure of the extra low profile housing. The wireless MIDI transmitting antenna is installed on the left forward corner of the bassboard housing's top surface (Part 9, Part 1, FIG. 1).

Figure 5:
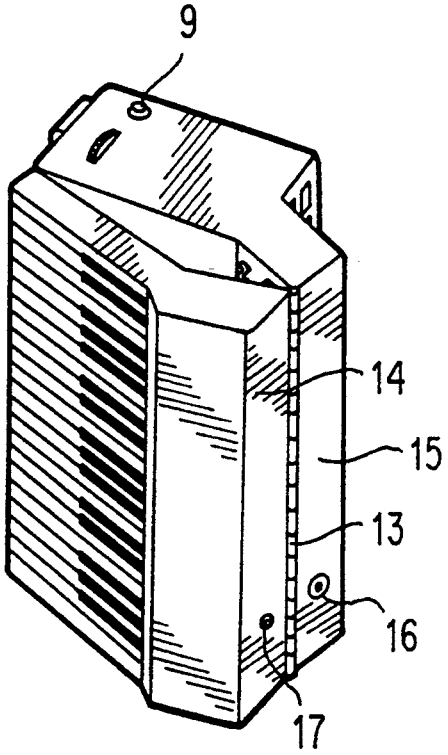

FIG. 4 and FIG. 5 clearly show the features contained in the Folding Version of the Extra Low Profile Housing for Vertical Dual Keyboard MIDI Wireless Controller for Accordionists the over-all shape and contour of which remains the same. The primary and the secondary control panels remain where they are supposed to be. FIG. 4 illustrates the fact that the instrument's housing is cut in half (longitudinally across the entire rectangular mid section) and how a piano hinge (Part 13, FIG. 4) connects the two halves of the mid section's back surface (Part 2, FIG. 4), and FIG. 5 shows the instrument fully folded in half revealing the inner lateral rectangular end cap of the divided mid section which is part of the right-hand keyboard and the second inner lateral rectangular end cap of the divided mid section which is part of the left-hand bassboard (Part 14 and Part 15, FIG. 5 in that order). The two matching points of contact (Part 16, Part 17, FIG. 5), reestablish the electronic connection between the two halves of the instrument each time said two lateral inner rectangular end caps join together in a playing position as shown in FIG. 4.

In this format the instrument is actually a Sectionalized Modular Version of the Extra Low Profile Housing for Vertical Dual Keyboard MIDI Wireless Controller for Accordionists divided in three separate interlocking sections as shown in FIG. 6. The right-hand keyboard's housing (Part 3, FIG. 6) retains the secondary control panel in the same position and its inner rectangular end cap features lengthwise a dove-tail like protruding track (Part 18, FIG. 6) that is designed to interlock longitudinally with the rectangular mid section's lateral matching dove-tail groove (Part 19, FIG. 6), directly opposite the second lateral mid section's rectangular surface incorporating longitudinally a dove-tail protruding track (Part 20, FIG. 6) which in turn interlocks lengthwise with the matching dove-tail groove carved out of the inner rear portion of the lateral surface of the rectangular bassboard housing. (Part 21, FIG. 6). FIG. 7 shows Part 22 and Part 23—two of the electronic points of contact that are found on each one of the two protruding dove-tail tracks and in each one of the two matching dove-tail grooves which are essential to provide the necessary electronic contact between the three modular interlocking sections. FIG. 8 shows the three instrument's sections fully assembled.

This format represents the Dual-Purpose Version of the Extra Low Profile Housing for Vertical Dual Keyboard MIDI Wireless Controller for Accordionists that can be played either as a vertical instrument (like an accordion) or like any horizontal keyboard as shown in FIG. 11. FIG. 9 and FIG. 10 show the instrument again divided in two sections (the main basic features again remain the same). The mid section is cut longitudinally in half. A hinge holds together, at the top of the instrument, the two divided segments of the instrument's mid section. Said two divided instrument's sections at their opposite ends are held in place by a special latch (Part 29, FIG. 9) and when the instrument's two halves are joined together, the two electronic connecting points (Part 24 and Part 25, FIG. 10 appearing on the lateral inner end cap (Part 15, FIG. 11) of the divided mid section which is part of the left-hand bassboard housing, make contact with their two matching counterparts (Part 31 and Part 30, FIG. 11 in that order) and therefore establish the electronic connection necessary between the two sections of the instrument when played in a vertical position. In order to pass from a vertical playing position to a horizontal playing position, the bottom latch (Part 29, FIG. 9) of the instrument must be released and the two bottom halves must be gradually separated in a fan-like fashion (as gradually shown in FIG. 9 and FIG. 10) until a full 180° semi-circle is completed and Part 1 and Part 3, FIG. 9 and the two contact points (Part 27 and Part 28, FIG. 10) located on the two divided short segments of Part 2, FIG. 9 join tightly together establishing the proper connection between the two instrument's sections.

I claim:

1. An extra low profile housing for vertical dual keyboard MIDI or Wireless MIDI Controllers for accordionists comprising three vertically oriented rectangular segments; the first one of said three segments being three and one-half to four inches deep comprising a lateral left surface, a back surface, a top and a bottom surface, a front surface incorporating a left-hand bassboard assembly, and containing a primary control panel positioned lengthwise on a lateral right surface; the longitudinally adjacent second rectangular section of said three rectangular segments being not more than two and one-quarter inches deep, having a front and a back surface, a top and a bottom surface, and containing a secondary control panel arranged longitudinally on a lateral right surface; the subsequent adjoining third and last section of said three rectangular segments being one and one-half inches deep, having a top and a bottom surface, a lateral right surface, and having lengthwise a back surface directly opposite a right-hand keyboard representing and constituting the front surface of said third and last section.

2. A folding extra low profile housing for vertical dual keyboard MIDI or Wireless MIDI Controllers for accordionists comprising three vertically oriented rectangular segments of equal length; the first one of said three segments being three and one-half to four inches deep, having a lateral left surface, a back surface, a top and a bottom surface, a front surface incorporating a left-hand bassboard assembly, and containing a primary control panel positioned lengthwise on a lateral right surface; the longitudinally adjacent second section of said three rectangular segments not more than two and one-quarter inches deep, being dissected lengthwise in two sections representing a left half side and a right half side; said left half side having a top and a bottom surface, a front and a back surface and a lateral right surface; said right half side having a top and a bottom surface, a front and a back surface, a lateral left surface and a lateral right surface containing a secondary control panel; said secondary control panel adjoining lengthwise the third and last subsequent one and one-half inches deep section of said three rectangular segments having a top and a bottom surface, a lateral right surface and having a back surface directly opposite a right-hand keyboard representing and constituting the front surface of said third and last section; furthermore, said back surface of said left half side central portion being connected longitudinally to said back surface of said right half side central portion by means of a piano hinge; said piano hinge making it possible for said MIDI or Wireless MIDI Controllers to fold for added portability.

3. An interlocking modular extra low profile housing for vertical dual keyboard MIDI or Wireless MIDI Controller for accordionists comprising three separate vertically oriented interconnectable modular rectangular segments; the first one of said three modular segments being three and one-half to four inches deep, comprising a lateral left surface, a back surface, a front surface incorporating a left-hand bassboard assembly, a top and a bottom surface, and a lateral right surface containing in its longitudinal front half portion a primary control panel and incorporating in its longitudinal rear half portion a dove-tail like recessed track; the second one of said three interconnectable rectangular segments being not more than two and one-quarter inches deep, having a top and a bottom surface, a front and a back surface, a left lateral surface incorporating a dove-tail like interlocking protruding track, and a right lateral surface containing a dove-tail like recessed interlocking track; the remaining third separate section of said three rectangular interconnectable modular segments having a left lateral surface not more than two and one-quarter inches deep incorporating a dove-tail like interlocking protruding track, a front surface, a lateral right surface containing a secondary control panel; said lateral right surface merging lengthwise with the inner edge of the one and one-half inches deep right-hand keyboard assembly comprising a lateral right surface, a back surface, a front surface consisting of a keyboard, and a top and a bottom surface matching both the one and one-half inch depth of said keyboard assembly and the two and one-quarter inch depth of said left lateral surface incorporating said interlocking protruding track and containing said secondary control panel.

4. A dual-purpose extra low profile housing for dual keyboard MIDI or Wireless MIDI Controllers for accordionists to be used either vertically or horizontally; said dual-purpose housing comprising three vertically oriented rectangular segments; the first one of said three segments being three and one-half to four inches deep, comprising a lateral left surface, a back surface, a top and a bottom surface, a front surface incorporating a left-hand bassboard assembly, and a lateral surface containing a primary control panel; the longitudinally adjacent second one of said three rectangular segments being not more than two and one-quarter inches deep, and being dissected in two sections respectively representing a left side half and a right side half; said left side half having a top and a bottom surface, a front and a back surface, and a lateral right surface; said right side half having a top and a bottom surface, a front and a back surface, a lateral left surface, and a lateral right surface containing a secondary control panel; said lateral right surface merging lengthwise with the inner edge of the right-hand keyboard; said keyboard representing the front surface of the keyboard assembly comprising a lateral right surface, a back surface, a top and a bottom surface matching the same dimensions of both the one and one-half inch deep portion of said keyboard assembly and the two and one-quarter inch deep portion of said right side half of said dissected second segment containing said secondary control panel; said left side hall's top surface of said dissected section of said three rectangular segments and said right side hall's top surface of same dissected section being connected by means of a short hinge; said hinge making it possible for said left side half and said right side half of said dual-purpose housing to either join together to be used vertically like an accordion, or to separate and gradually fan out to a full 180° at which point said left side half's top surface and said right side half's top surface join together thus causing the aligment of both left-hand bassboard and righthand keyboard in a straight horizontal position to be used like a piano.

* * * * *